United States Patent [19]

Oguchi et al.

[11] 4,155,883

[45] May 22, 1979

[54] TONER FOR ELECTROSTATIC IMAGE DEVELOPMENT

[75] Inventors: Toshihiko Oguchi, Kawasaki; Ichiyoshi Saito, Tokyo, both of Japan

[73] Assignee: Tokyo Shibaura Electric Co., Ltd., Japan

[21] Appl. No.: 795,965

[22] Filed: May 11, 1977

[30] Foreign Application Priority Data

May 12, 1976 [JP] Japan ..... 51-53151

[51] Int. Cl.[2] ..... G03G 9/08

[52] U.S. Cl. ..... 252/62.1 P; 428/407; 96/1 SD

[58] Field of Search ..... 252/62.1 P; 96/1 SD; 428/407

[56] References Cited

U.S. PATENT DOCUMENTS

| | | | |
|---|---|---|---|
| 3,175,935 | 3/1965 | Vanstrum | 428/407 |
| 3,506,469 | 4/1970 | Titow | 252/62.1 P |
| 3,676,350 | 7/1972 | Wright et al. | 252/62.1 P |
| 3,884,825 | 5/1975 | Lindblad et al. | 252/62.1 P |
| 3,938,992 | 2/1976 | Jadwin et al. | 252/62.1 P |

OTHER PUBLICATIONS

Lee et al., "Handbook of Epoxy Resins", Published 3/21/67, McGraw Hill Book Co., pp. 7-1, 7-30, 9-1, 9-3, 10-19.

*Primary Examiner*—Roland E. Martin, Jr.
*Attorney, Agent, or Firm*—Finnegan, Henderson, Farabow & Garrett

[57] ABSTRACT

Toner for electrostatic image development, comprising a toner body powder which contains a thermoplastic resin binder having a first reactive functional group and a micro powder which has a second reactive functional group capable of a curing reaction with the first reactive functional group. Owing to the curing reaction between the first and second reactive functional groups, the micro powder particles are bonded on the particles of the toner body powder. Thus the toner is powder particles with non-adhesive surfaces and possesses a good preservation stability. Over a long time after its manufacture the toner can provide clear developed images.

5 Claims, No Drawings

TONER FOR ELECTROSTATIC IMAGE DEVELOPMENT

BACKGROUND OF THE INVENTION

This invention relates to a toner for electrostatic image development, particularly to toner which has a good preservation stability and can therefore provide clear developed images over a long time after its manufacture.

Generally, in electrophotography a colored resin powder, i.e., toner is contacted with a photosensitive plate or paper with an electrostatically charged image. The toner particles are deposited on the surface of the photosensitive plate or paper by the electrostatic attraction between themselves and the electrostatically charged image. In this manner a visible image is developed on the plate or paper. The developed image may be transcribed from the photosensitive plate on to a plain paper. And the toner particles are thermally fused to the surface of the photosensitive paper or plain paper, thereby to fix the visible image on the paper.

The above described is called dry development method. In this method the toner is mixed with a carrier in order to electrically charge the toner to a necessary degree and to contact the toner particles with the photosensitive plate or paper in uniform concentration. There are several dry development methods. For example, one is called cascade development in which the mixture of toner and carrier, i.e., developing agent, is applied onto a photosensitive plate or paper. Another is called magnetic brush development in which a magnetic brush is used. The magnetic brush consists of a magnet with a mass of iron fillings. To the brush, toner mixture is attached by magnetic attraction. Image development is accomplished simply by brushing the surface of the photosensitive plate or paper. During this development only the toner particles are detached from the brush and are deposited onto the surface of the photosensitive plate or paper.

In either dry development method, however, it is difficult to keep clear the surface of each carrier particle since the toner particles adhere to the carrier particles.

If the toner particles adhere to the carrier particles, the toner fails to be charged electrically to necessary degree, thus degrading the quality of the developed image. Further, the toner particles are deposited unnecessarily onto those portions of the photosensitive plate or paper where no image is electrostatically formed. If not clear of unnecessary toner particles, the photosensitive plate or paper adversely serve to degrade very much the quality of the developed electrostatic image, particularly in case it is repeatedly used and subjected to electrical charging, exposure, development and transcription many times.

Moreover, the toner contains a thermoplastic resin binder which melts or softens at a relatively low temperature. While being used or preserved, it may therefore easily turn into a block, mass or cake according to the ambient temperature. If this happens, the toner loses its function as a development toner.

To lengthen the life time of such toner or to elevate the preservation stability of such toner, many attempts have been made. For example, it has been proposed to mingle a non-adhesive filler or a non-adhesive metal soap with such toner, or to add micro powder or an oily substance to such toner. Such techniques are disclosed in Japanese Patent Publications Nos. 37-4695, 43-26716, 44-6398, 44-27879 and 44-32470 and in Japanese Patent Disclosures Nos. 48-47345 and 48-47346. But the toner does not exhibit a satisfactory preservation stability, and the quality of the developed images it provides are not good enough.

SUMMARY OF THE INVENTION

An object of this invention is to provide a toner for electrostatic image development, which has a good preservation stability and provides clear developed images over a long time of its use.

The toner according to this invention comprises a toner body powder which contains a thermoplastic resin binder having a first reactive functional group and a micro powder which has a second reactive functional group capable of a curing reaction with the first reactive functional group, the micro powder particles being bonded on the particles of the toner body powder owing to the curing reaction between the first and second reactive functional groups, whereby the toner body powder particles have non-adhesive surfaces.

DETAILED DESCRIPTION OF THE PREFERRED EMBODIMENTS

To obtain the toner according to this invention, a toner body powder containing a thermoplastic resin binder having a reactive functional group is mixed with a micro powder having a reactive functional group capable of a curing reaction with the reactive functional group of the binder. Thus the micro powder particles are laid on the surface of the toner body powder particles or partially embedded in the toner body powder particles. Then, a curing reaction takes place between the reactive functional groups of the toner body powder and that of the micro powder. As a result, the micro powder particles are integrated with the toner body powder particles. Now with micro powder particles fixed to its surface, each toner body powder particle becomes non-adhesive. Thus obtained is a toner for electrostatic image development, whose particles have non-adhesive surfaces.

The micro powder particles can be easily bonded to the toner body powder particles. For instance, the micro powder and the toner body powder may be mixed together at about the softening point of the binder in the toner body powder. Or a solvent such as water may be added to the mixture of these powders, and the resultant slurry may be sprayed into a hot air flow to evaporate the solvent.

The curing reaction between the toner body powder and the micro powder may be carried out at room temperature or while the mixture of these powders is heated. But it is preferred that the reaction be carried out at a relatively low temperature, for example 40° to 80° C.

The binder contained in the toner body powder is formed of a thermoplastic resin such as bisphenol A epoxy resin, epoxy-novolak resin and an epoxy, amino or silicon resin modified by phenol, acrylic acid or silicon. Instead the binder may be prepared by adding a hardening agent made of polyol, primary, secondary and tertiary amines and a silicon such as trialkoxysilane to a natural resin, styrene resin, styrene-acrylic copolymer, styrene-butadiene copolymer, polyvinyl chloride, polyvinyl acetate, polyethylene, polypropylene or the like.

The micro powder is formed of $SiO_2$, $TiO_2$, $TiBaO_3$, $Al_2O_3$, $Si_3N_4$, ZnO, MgO, $CaCO_3$, $BaSO_4$, clay, magnetite, red iron oxide, an organic dye or the like. The micro powder is subjected to surface treatment by a compound which is capable of a curing reaction with the reactive functional group of the binder contained in the toner body powder. Such a compound is selected according to the reactive functional group of the binder. If the binder has epoxy group, a compound having amino group (e.g. various hardening agents) is selected. If the binder has isocyanate group, a compound having polyol group is chosen. Reversely, if the binder has amino or polyol group, a compound having epoxy or isocyanate group is selected.

The micro powder need not be surface-treated by a compound having a reactive functional group if it has a reactive functional group. This is because the reactive functional group of such a micro powder reacts with that of the binder. As such a micro powder, powder of $SiO_2$ having surface OH group and an organic dye having amino group can be used.

As mentioned above, the particles of the toner of this invention have non-adhesive surfaces and do not soften at normal temperatures. Thus they neither coagulate nor fuse together to form masses, provided that electrostatic images are not developed or copied at an abnormally high temperature. For this reason, the toner maintains its stability and its good fluidity not only while preserved but also while used. It is not likely to contaminate the surfaces of the carrier particles or on those portions of the photosensitive paper where no image is electrostatically formed. If unnecessary toner particles fall onto the carrier particles or on the photosensitive paper, they can easily be removed since they, provided with micro powder particles on their surfaces, rub one another strongly and prevent one another from obstinately sticking to the carrier particles or the photosensitive paper. The surface of the carrier particles or the surface of the photosensitive paper can therefore be kept clear of unnecessary toner. Consequently, the developing agent consisting of the toner and the carrier is completely protected against deterioration of its developing properties, and can thus provide clear developed images over a long time.

The toner according to this invention is prepared, for example, merely by mixing the toner body powder and the micro powder. Thus it is manufactured quite easily and with a high reproducibility. Further, the thickness of the non-adhesive or non-softening layer of each toner particle can be easily controlled only by adjusting the amount of the micro powder to be bonded with the toner particles. In addition, a binder having a low melting point may be used as toner binder. These are the practical advantageous features of the toner of the invention.

A few examples of this invention will be now shown.

EXAMPLE 1

2 weight parts of polyamide resin, Versamid (trade name, First General, Inc.) was added to 30 weight parts of ethyl alcohol to form a solution. 100 weight parts of magnetite (mean particle size: 0.3 micron) was added to the solution and mixed with the same. Then, the resultant mixture was heated and dried by spray dry method, evaporating ethyl alcohol. Thus there was obtained magnetite powder surface-treated by polyamide resin.

Meanwhile, 100 weight parts of epoxy resin, Epicoat #1002 (trade name, Shell Oil, Inc.) and 10 weight parts of carbon black were mixed together while heated. A lump of the mixture was pulverized, and the resultant particles were classified. Finally a toner body powder having a particle size of 5 to 20 microns was obtained.

100g of the toner body powder and 10g of the surface-treated magnetite powder were mixed. The mixture of these powders was fed into a fluid bed mixer of hot air flow type which was maintained at 65° C. In the mixer the mixture was processed for 30 minutes, while forming a fluidized bed. As a result, there was obtained a toner particles which were substantially spherical. The toner particles were observed under a scanning type microscope. The microscopic observation revealed that the magnetite particles covered the surface of each toner body particle, partially embedded in the toner body particle. The surfaces of the toner particles were thus proved to be non-adhesive.

The toner thus obtained was stored into a constant temperature bath maintained at 45° C., and a blocking test was conducted. Even 100 hours thereafter no blocking occurred. This proved that the toner had a good stability.

Further, 2 weight parts of the toner was mixed with 100 weight parts of iron powder (i.e., carrier) the particle size of which was 50 to 100 microns, thus preparing a developing agent. Using the developing agent, a negatively charged electrostatic image formed on an organic photosensitive paper was developed by the magnetic brush development, and a number of positive image copies were obtained, which were clear ones. The positive image did not deteriorate even on the 5,000th copy. The developing agent containing the toner of this invention was therefore thought to have an excellent electrical charge characteristic.

To prove the good electrical charge characteristic of the above-mentioned developing agent, a toner body powder which consists of only the epoxy resin and carbon black was subjected to the same blocking test. Only 5 hours after the toner body powder was fed into the tank, blocking took place in the toner body powder, and the toner body powder started to cake. This toner body powder and the above-mentioned iron powder were mixed in the same mixing ratio, thus forming a developing agent. Using the developing agent, a negatively charged electrostatic image on an organic photosensitive paper of the same type was developed by the magnetic brush development. As a result, a number of positive image copies were obtained. But these copies were unclear.

EXAMPLE 2

One weight part of a 4-functional epoxy compound was added to 30 weight parts of ethyl alcohol to form a solution. 100 weight parts of magnetite (mean particle size: 0.3 micron) was mixed with the solution. The resultant mixture was then stirred in a vacuum kneader maintained at 120° C., thereby removing ethyl alcohol. Thus, there was obtained magnetite powder surface-treated by the epoxy compound. 10 weight parts of the surface-treated magnetite powder was mixed with 100 weight parts of a toner body powder, particles of which are made of a mixture of amino resin and carbon black. The mixture of these powders was fed into the fluid bed mixer of hot air flow type which was maintained at 65° C. Consequently, there was obtained a toner particles, i.e., toner body powder particles covered-with surface-treated magnetite powder particles and having non-adhesive surfaces.

Then, 3 weight parts of the toner thus obtained was mixed with 100 weight parts of reduced iron powder (i.e., carrier) the particles of which were spherical and had a diameter of 100 microns, thereby forming a developing agent. Using this developing agent, a negatively charged electrostatic image formed on a ZnO-coated photosensitive paper was developed by the magnetic brush development. As a result, a number of positive image copies were obtained, which were all clear with no toner on the background area. No deterioration of the positive image was observed even on the 10,000th copy. It was therefore found that the developing agent containing the toner of this invention has an excellent anti-deterioration characteristic, too.

Further, in order to estimate the preservation stability of the toner, the toner was kept in the constant temperature bath maintained at 45° C. for seven days. On the eighth day the toner was examined, and it was ascertained that no blocking had taken place in the toner.

Moreover, instead of amino resin, a thermoplastic resin containing a hardening agent commonly used for hardening epoxy resins, such as diethylenetriamine, triethylenetetramine, heterocyclic diamine, tetraethylenepentamine, polyamide resins and the like, was mixed with carbon black to form a toner body powder. This toner body powder and the above-mentioned surface-treated magnetite powder were mixed, and the mixture of these powders was made into a toner particles. The toner thus obtained was kept in the constant temperature bath at 45° C. for seven days. On the eighth day the toner was examined, and it was found that no blocking had occurred in this toner, either.

EXAMPLE 3

10 weight parts of direct blue BB (dye C.I. 22610) and 100 weight parts of zinc oxide powder (mean particle size: 0.2 micron) were added to 30 weight parts of ethyl alcohol to form a solution. As in Example 1, the solution was dried by spray dry method, evaporating ethyl alcohol. Thus there was obtained zinc oxide powder, the particles of which were coated with a dye layer having amino group.

Meanwhile, 50 weight parts of epoxy resin, Epicoat #1002 (trade name, Shell Oil, Inc.), 50 weight parts of magnetite powder and 10 weight parts of carbon black were mixed together. While heated, the mixture was kneaded. A lump of the mixture was pulverized and the resultant toner body powder was classified.

Then, 10 weight parts of the zinc oxide powder and 100 weight parts of the toner body powder (mean particle size: 20 microns) were mixed. The mixture of these powders was fed into the mixer of hot air flow type which was maintained at 50° C. In the pulverizer the powder mixture was kept for about 60 minutes, curing which time a toner was prepared. This toner was found to consists of toner body particles each being covered with the dye-coated zinc oxide particles and having a non-adhesive surface.

The toner was kept in the constant temperature bath maintained at 45° C., for seven days. On the eight day it was examined. No blocking had taken place in it, and the toner was proved to have a good preservation stability. Since its particles contained magnetite which is a magnetic material, the toner could serve as a developing agent without assistance of a carrier. Using this toner, a negatively charged electrostatic image formed on a photosensitive paper was developed. The developed image was sharp and clear.

Further, instead of direct blue BB, direct black BH (C.I. 22590) having amino group was used to surface-treat the zinc oxide powder. The surface-treated zinc oxide powder was mixed with the toner body powder. Also in this case the resultant toner was proved to have a good preservation stability. The same effected was obtained when direct skyblue 5B (C.I. 24400) having amino group was employed, in place of direct blue BB, to surface treat the zinc oxide powder.

EXAMPLE 4

20 weight parts of Barifast Black #3804 (trade name, a metal-containing azo-dye, Orient Chemical Industries Co., Ltd.) was added to 100 weight parts of colloidal titanium dioxide powder (mean particle size: 10 millimicrons). The dye and the titanium dioxide were mixed in a ball mill thoroughly for 20 hours, thus obtaining a black powder.

In the meantime 50 weight parts of epoxy resin, Epicoat #1002 (trade name, Shell Oil, Inc.) and 50 weight parts of magnetite powder were mixed. The mixture was kneaded, while it was heated. A lump of the mixture was pulverized, and the resultant particles were classified. Thus there was obtained a toner body powder (mean particle size: 15 microns).

Then, 5 weight parts of the black powder was mixed with 100 weight parts of the toner body powder. The mixture of these powders was well stirred by a vibration mixer. During this stirring process the black powder particles stuck on the toner body particles, thereby obtaining a toner. The toner thus obtained was sprayed by an ejector-feeder into an atmosphere of about 400° C. Sprayed in this manner, the toner body particles were made spherical. Concurrently the fine black powder particles were firmly bonded to the toner body particles.

The toner proved to have a good fluidity. It was kept in the constant temperature bath maintained at 45° C. for 10 days. On the tenth day the toner was examined, and it was ascertained that no blocking had occurred in the toner. Thus the toner exhibited a good preservation stability. Since its particles contained magnetite which is a magnetic material, the toner could be applied directly to the magnetic brush development without assistance of a carrier. In the magnetic brush development the toner served to develop a clear positively charged electrostatic image formed on a photosensitive paper.

What we claim is:

1. A toner for electrostatic image development, comprising (1) a toner body powder which contains a thermoplastic resin binder having a first reactive functional group and (2) a micro powder which has a second reactive functional group capable of a curing reaction with the first reactive functional group, the particles of said micro powder being substantially smaller than the particles of said toner body powder and being bonded on and substantially covering the particles of said toner body powder owing to the curing reaction between the first and second reactive functional groups, whereby the particles of the toner have non-adhesive surface layers.

2. The toner according to claim 1, wherein said micro powder has its particles surface-treated with a compound having the second reactive functional group.

3. The toner according to claim 1, wherein said micro powder is formed of a material having the second reactive functional group.

4. The toner according to claim 1, wherein the combination of the first and second reactive functional groups is selected from a group consisting of epoxy group-amino group, isocyanate group-polyol group, amino group-epoxy group and polyol group-isocyanate group.

5. The toner according to claim 1, wherein said toner body powder contains magnetic particles.

* * * * *